United States Patent [19]

Cramer

[11] Patent Number: 4,804,187

[45] Date of Patent: Feb. 14, 1989

[54] GAME ASSEMBLY BASED ON THE PHI FACTOR

[76] Inventor: John O. Cramer, 140 Prospect St., Providence, R.I. 02906

[21] Appl. No.: 100,540

[22] Filed: Sep. 24, 1987

[51] Int. Cl.[4] ..... A63F 9/12

[52] U.S. Cl. ..... 273/157 R; 434/195

[58] Field of Search ..... 273/156, 157 R; 434/195, 211, 207

[56] References Cited

U.S. PATENT DOCUMENTS

| | | | |
|---|---|---|---|
| 1,885,207 | 5/1940 | Wormser | 273/157 |
| 2,188,480 | 1/1940 | Murray | 434/211 X |
| 2,901,256 | 8/1959 | Way | 273/157 |
| 3,204,343 | 9/1965 | Pollock | 434/195 |
| 3,510,134 | 5/1970 | Brooks et al. | 273/157 |
| 3,667,760 | 6/1972 | Nelson | 273/157 |
| 3,698,122 | 10/1972 | Adams | 434/211 X |
| 3,771,795 | 11/1973 | Flanigan | 273/157 |
| 4,129,302 | 12/1978 | Stone | 273/287 X |
| 4,133,152 | 1/1979 | Penrose | 52/105 |
| 4,189,151 | 2/1980 | Klopfenstein | 273/156 |
| 4,210,333 | 7/1980 | Shanin | 273/157 |
| 4,257,175 | 3/1981 | Wentworth | 434/208 |
| 4,260,385 | 4/1981 | Gulack | 434/208 |
| 4,343,471 | 8/1982 | Calvert | 273/157 |
| 4,518,359 | 5/1985 | Yao-Psong | 434/195 |

OTHER PUBLICATIONS

"The 2nd Scientific American Book of Mathematical Puzzles and Diversions" by Martin Gardner, copyright 1961, publ. by Simon and Schuster, New York, pp. 89–103.

*Primary Examiner*—Anton O. Oechsle

*Attorney, Agent, or Firm*—Kenway & Crowley

[57] ABSTRACT

A puzzle or game including a set of pieces combinable to form a rectangular array and a retainer for holding said pieces in a tubular or circular form dimensioned in accordance with the Phi factor, ($\phi$). The set of pieces is divided into three subsets of different colors to be combined in rows of equal length in which no piece of any given subset abuts any other piece of the same subset end-to-end or side-to-side. The pieces carry indicia also to be combined in the array in distinctive fashion related to $\phi$.

18 Claims, 2 Drawing Sheets

GAME ASSEMBLY BASED ON THE PHI FACTOR

This invention relates in general to puzzles and games in the fields of education and entertainment, and in particular to a group of geometric pieces which can be combined in accordance with certain of their characteristics to form any one of a number of predetermined arrays.

More specifically, the invention is concerned with the combining of a set of similar pieces having a common dimension which is uniquely mathematically related to a comparable dimension of all other pieces of the plurality, the pieces having markings and colors to be considered in forming the arrays.

BACKGROUND OF THE INVENTION

The art is replete with games, puzzles, educational toys, models and various mathematical recreations involving the assembly of geometric pieces into some type of pattern or structure. A considerable body of literature on the subject exists and continues to grow with the issuance of new patents and publications for educators, students, and hobbyists. An excellent review and compilation of the art may be found in *Puzzle Craft* by Stewart T. Coffin (1985; published by Stewart Coffin, 79 Old Sudbury Road, Lincoln, Mass. 01773). Another extensive survey may be found in *Puzzles Old & New, How To Make and Solve Them* by Jerry Slocum and Jack Botermans (1986, Plenary Publication International (Europe) bv, De Meern, The Netherlands and ADM International bv, Amsterdam, The Netherlands).

Even a cursory review of the literature will indicate that many of the puzzles which are most popular involve the combining or arranging of a group of pieces in some particular way or ways which constitute the solution of the puzzle. The present invention, although it has applications in education, architecture and design in general can probably best be understood in the context of such "combinatorial puzzles".

A basic underlying concept of the present invention involves component pieces and accessories having dimensions scaled by values in the geometrical and additive series of Phi, thus demonstrating the proportion known as the "Golden Section". The proportion derived from the ratio Phi has been used in the art and architecture for the creation of proportional form and may be expressed as:

$$\frac{1+\sqrt{5}}{2}$$

which is equal to 1.618 . . . . Much has been written of the golden section, and a particularly valuable publication of the subject is *The Geometry of Art and Life* by Matila Ghyke, Dover Publications, Inc., New York, N.Y. 10014 (1977).

For present purposes, it is sufficient to note that the number or ratio, or proportion Phi has been designated $\phi$ and has long been known to have properties as remarkable in their way as the better known number $\pi$. For example, concerning the geometrical and additive series:

$$\phi = \frac{\sqrt{5}+1}{2} = 1.618\ldots$$

-continued $$\phi^2 = 2.618\ 1 + \phi = 2.618$$

$$\phi^3 = 4.236\ \phi + \phi^2 = 4.236$$

$$\phi^4 = 6.854\ \phi^2 + \phi^3 = 6.854$$

etc.

Also, $\phi = \frac{\sqrt{5}+1}{2} = 1.618$ and $\frac{1}{\phi} = \frac{\sqrt{5}-1}{2} = 0.618$ Generally, then: $\phi^n = \phi^{n-1} + \phi^{n-2}$ and $\phi = 1 + \frac{1}{\phi}$ There is at least one puzzle known in the art which involves dissimilar pieces each having a side length related to powers of the golden section, the pieces being combinable to form various polygons and other geometric figures. This puzzle is disclosed in U.S. Pat. No. 4,343,471, Pentagonal Puzzle, issued Aug. 10, 1982 to Calvert.

It is a primary object of this invention to utilize the additive and geometrical properties of the Golden Section in a challenging mathematical recreation.

Another object is to provide a geometric puzzle which is playable at different degrees of difficulty.

Still another object is to aid the teaching of mathematical relationships and the understanding and appreciation of art.

A further object is to provide a puzzle which when solved expresses the symmetry of geometric form and color.

SUMMARY OF THE INVENTION

The present invention is organized about a set of similar geometric pieces all having a dimension of a value which is in the continuous geometrical and additive series of Phi, ($\phi$). The pieces are combinable to form differing arrays which have similar patterns. For example, a group of rods is provided in various lengths related serially in accordance with the $\phi$ factor. The rods are then to be combined into any of numerous arrays of rows of equal length. The rods may be of equal and unequal lengths, but all are of lengths related to the $\phi$ factor. In a specific case, one may have four rods of unit length, ($\phi^0$); seven rods of $\phi$ times the unit length, ($\phi$); four rods of $\phi^2$ times the unit length, ($\phi^2$); two rods of $\phi^3$ times the unit length, ($\phi^3$); and one rod of $\phi^4$ times the unit length ($\phi^4$). In the set of rods one group has one color, another group a second color, and a third group a third color. Then, it is the object of the puzzle to form six adjoining rows such that no rods of the same color touch either end-to-end or side-to-side. Yet greater difficulty may be imposed by requiring the forming of the six rows into a continuous cylindrical surface while maintaining the condition of no end-to-end or side-to-side contact of rods of the same color.

In addition, or alternatively, the pieces may carry identifying indicia or markings related to each other in accordance with the $\phi$ factor. An objective may then be the assembly of the pieces with the markings in certain required positions relative to the other indicia without departing from the imposed pattern or array of colors.

Finally, the invention may include any of several devices or systems by which the pieces may be assembled together to form the object arrays. These may include transparent containers, magnetic mounting frames, or other mechanisms for retaining the pieces in a continuous surface array or other object configuration. These retainers may also be constructed in accordance with the $\phi$ factor.

For a better understanding of the present invention together with other objects, features and advantages, reference should be made to the following description of a preferred embodiment which should be read with reference to the appended drawings in which:

DESCRIPTION OF PREFERRED EMBODIMENT

Figure 1:
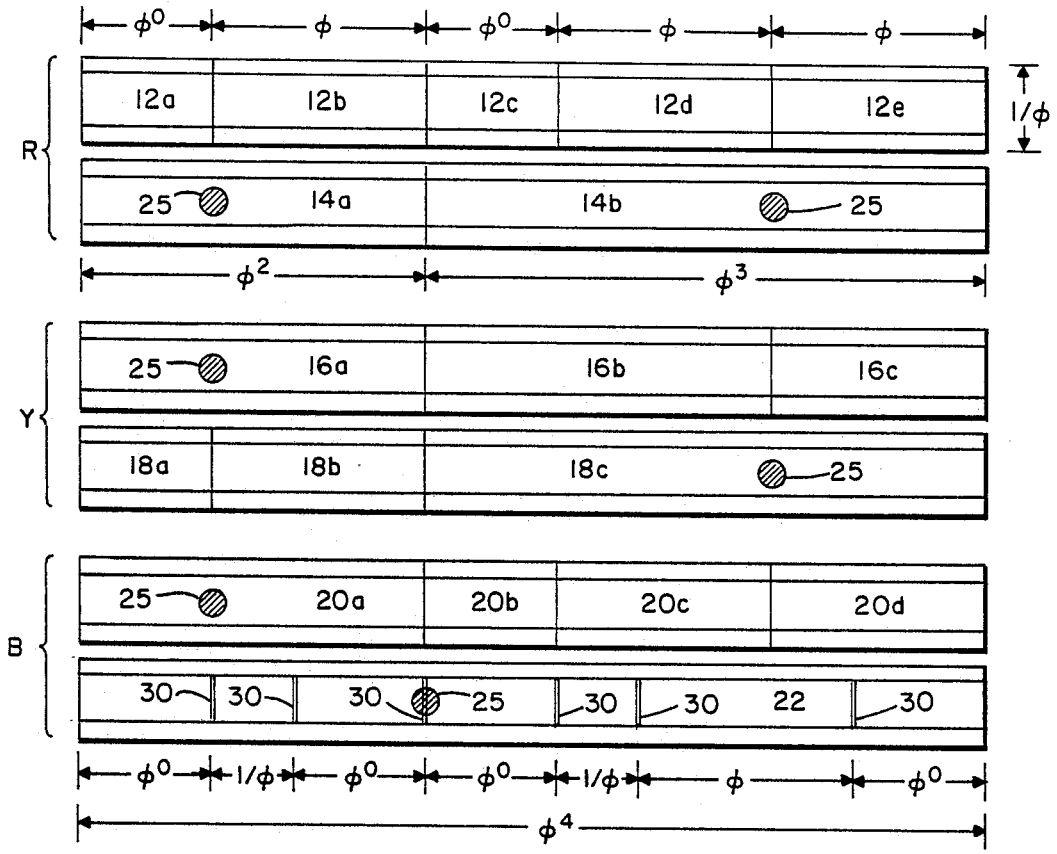
FIG. 1 is a top view of a set of pieces to be assembled into an array.

In FIG. 1, there is shown a set of pieces each having a rectangular surface. The pieces need not be rectangular in cross-section and, in fact, are preferred to be trapezoidal in cross-section. In the top view here, however, each rod presents a rectangular surface having a width of $1/\phi$. For purposes of simplification and ease of understanding, they will be referred to as "rectangular rods".

The rods are illustrated in three subsets arranged in rows according to color. It will be noted that rows 12 and 14 comprise a subset marked "R" for red. Row 12 includes a total of five pieces. Two of these pieces, namely, 12*a* and 12*c* are of unit length ($\phi^0$). The three other pieces 12*b*, 12*d* and 12*e* in row 12 are of length $\phi$. Turning to row 14, there are but two pieces 14*a* and 14*b*. The piece 14*a* is of length $\phi^2$ and the piece 14b is of length $\phi^3$. The grand total of red pieces in rows 12 and 14 is seven.

Rows 16 and 18, as indicated, comprise a subset of yellow pieces marked "Y". Row 16 includes three pieces 16*a* and 16*b* of length $\phi^2$ and piece 16*c* of length $\phi$. Row 18 includes three pieces, 18*a* of unit length $\phi^0$, 18*b* of length $\phi$, and 18*c* of length $\phi^3$. In total, in rows 16 an 18, there are six yellow pieces.

The subset comprised of blue pieces is shown in rows 20 and 22 marked "B". Row 20 includes a piece 20*a* of length $\phi^2$, pieces 20*c* and 20*d*, each of length $\phi$, and piece 20*b* of length $\phi^0$. Row 22 is composed of the single piece 22 of length $\phi^4$. The total number of blue pieces is five.

For purposes to be explained hereinbelow, the surfaces of the pieces 14*a*, 14*b*, 16*a*, 18*c*, 20*a*, and 22 are inscribed with dots 25. For each color or subset, there is a rod of length $\phi^2$ carrying a dot. For two colors or subsets there is a rod of length $\phi^3$ carrying a dot. For one color or subset there is one rod of length $\phi^4$ carrying a dot.

Summarizing, for the example here described, seven of the rods are red, six are yellow, and five are blue. Two rods of each color are inscribed with a dot, and in each case, the dots are positioned on the rods in the ratio of $1:\phi$ as dot position is to rod length.

The rod 22 is inscribed with six scale lines 30 which divide the rod length into seven increments of length $\phi^0$, $1/\phi$, $\phi^0$, $\phi^0$, $1/\phi$, $\phi$ and $\phi^0$.

Figure 2:
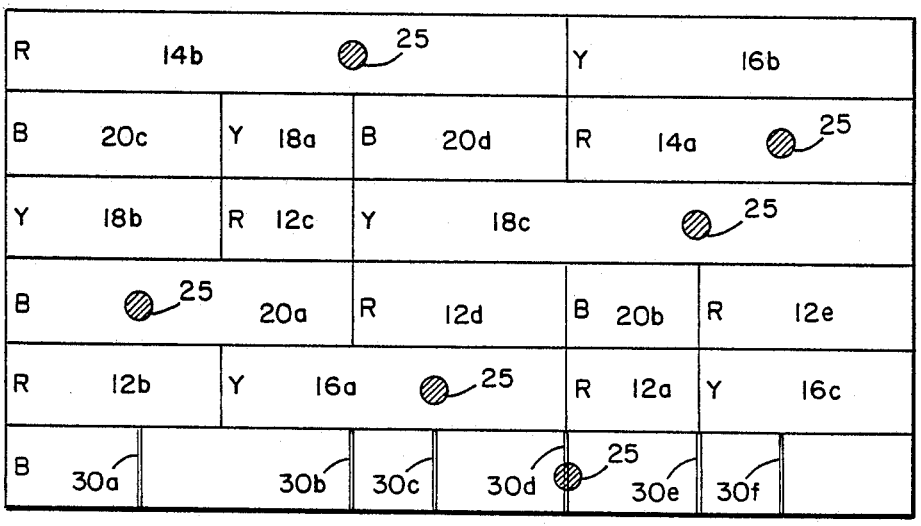
FIG. 2 illustrates graphically a solution in which the assembly of the pieces of the set of FIG. 1 satisfies certain requirements of the puzzle.

FIG. 2 illustrates graphically a solution to the puzzle. Individual pieces in the figure are legended B, Y, and R as in FIG. 1 denoting their colors, blue, yellow and red and also carry the same reference numerals used in FIG. 1. The pieces have been assembled in six rows so that no piece of like color meet, either end-to-end or side-to-side. They form a generally rectangular array as the term is used in this disclosure. Although FIG. 2 actually shows the rods arranged upon a flat surface to form the rectangular array, the term "rectangular array" may also describe the same array wrapped into a tubular or cylindrical form. Side-to-side contact between pieces of the same color is avoided between the first and last rows of the six when they are joined in the tubular form just as such contact is absent between all other rows. Specifically, the sixth row constituted by the blue rod 22 meets only with rods of other colors in the first row, the piece 14*b* being red and the piece 16*c* being yellow.

Figure 3:
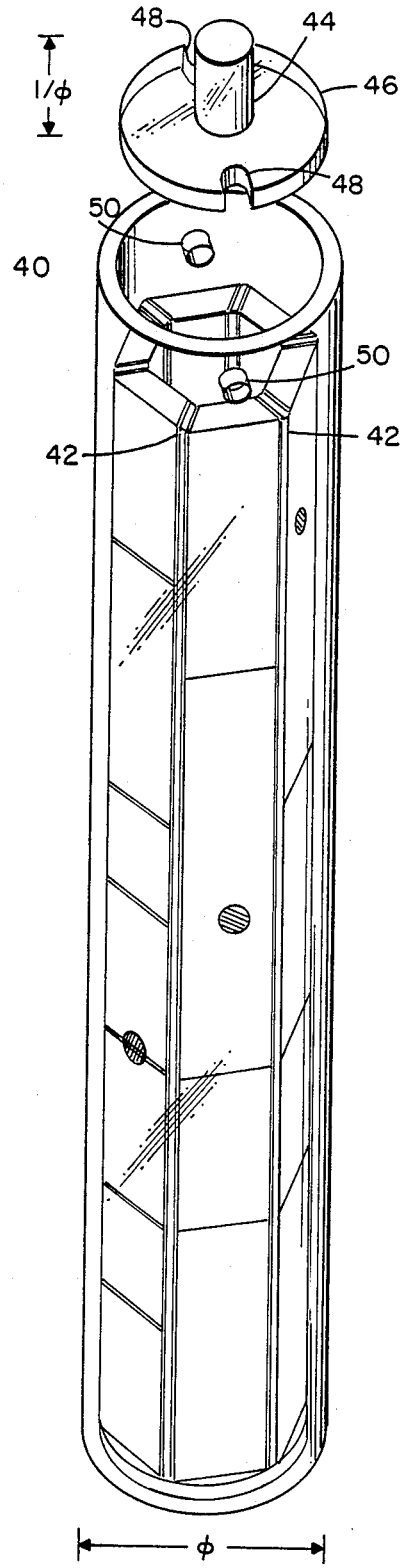
FIG. 3 illustrates a transparent cylindrical container which permits the pieces to be held as a continuous visible surface array.

In FIG. 3, there is shown a preferred retainer for the assembled pieces of the puzzle or game. The retainer contributes to the objective of displaying proportional form and color in accordance with the ratio $\phi$. The retainer consists of a transparent tube 40 of outside diameter $\phi$ made of a plastic such as acrylic having radial partitions 42 on its inner surface extending the length of the interior of the tube. The partitions project inwardly and with the inner surface form 3-sided compartments to accommodate rods of trapezoidal cross-section of which the pieces of the puzzle are made. The rods, however, are rectangularly surfaced, and the assembled array, although wrapped into a tube, still constitutes a rectangular array.

A stopper of overall height $1/\phi$ and made of the same transparent material includes a knob 44 extending axially outward and a notched disc 46 which fits into the cylindrical case 40. Diametrically opposite notches 48 are cut in the disc 46 and they cooperate with inwardly projecting radial pegs 50 to serve as a closure. The disc 46 may be inserted into the cylindrical case 40 with the notches 48 clearing the pegs 50. After the disc passes below the pegs 50, it may be turned so that the notches are no longer aligned with the pins and the stopper thus closes the case.

The first step in solving the puzzle is best taken by spilling all of the pieces on a flat surface and forming six rows, all the same length as the length of the longest rod. The pieces may then be shifted until the objective of no end-to-end or side-to-side like colors contacting is achieved. The pieces may then be inserted in order into the appropriate compartments of the cylindrical case 40. The tubular or wraparound solution of the puzzle in then clearly visible through the transparent walls of the case. Moreover, the disposition of the assembled colored rods constitutes a sculptural display of symmetry in form and color. The stopper may then be put into the case and turned to misalign the notches 48 with the radial pegs 50 to retain the pieces in place. Although there are literally hundreds of correct color combinations which solve the puzzle, they are not usually found quickly, and that adds to its fascination.

In addition to the color pattern solution, the additional indicia which the rods bear are useful in setting additional conditions to be met in solving the game or puzzle. The presence of the dots 25 and their location on certain of the pieces has been noted above. So also has the presence and location of the scale lines 30 on the longest rod 22 been remarked. The added complication which adds a degree of difficulty in solving the puzzle involves the positioning of a dot at each of the six positions along the length of the puzzle indicated by the scale lines on the longest rod 22 with only a single dot to appear in each row of rods.

Turning to FIG. 2, it may be seen that both the color and the dot-to-scale problems have been solved. The blue piece 20*a* has a dot positioned at the scale line 30*a*. The red piece 14*b* has a dot positioned at the scale line 30*b* and the yellow piece 16*a* has a dot positioned at the scale line 30*c*. The single blue piece 22 itself has a dot positioned at the scale line 30*d*. The yellow piece 18*c* has a dot positioned at the scale line 30*e* and the red piece 14*a* has a dot positioned at the scale line 30*f*.

With the added degree of difficulty imposed by the dot-to-scale condition, there are relatively few correct solutions to the puzzle. Discovery of those solutions poses a continuing challenge to the user of the puzzle.

What is claimed is:

1. A game comprising three sets of similar pieces having respectively differingly described surfaces combinable to form a predetermined six-sided array, said sides forming a continuous three-dimensional surface composed of said differingly designated surfaces, each said piece having at least a differingly designated surface to be exposed in said array and a dimension of magnitude related to a corresponding dimension of all other pieces in accordance with the $\phi$ series, wherein said array includes no exposed differingly designated surface of any piece of a given set of pieces in edge-to-edge contiguity with the exposed differingly designated surface of another piece of said given set of pieces.

2. A game as defined in claim 1 wherein said pieces comprise rectangular rods.

3. A game as defined in claim 2 wherein said dimension comprises the length of each of said rectangular rods.

4. A game as defined in claim 3 wherein each of said rectangular rods has a length selected from the lengths $\phi^0$, $\phi$, $\phi^2$, $\phi^3$, and $\phi^4$.

5. A game as defined in claim 2 wherein said surfaces of said differingly designated sets of rectangular rods constitute three subsets of different colors.

6. A game as defined in claim 5 in which one subset comprises five rods of a first color, a second subset comprises six rods of a second color, and a third subset comprises seven rods of a third color.

7. A game as defined in claim 5 wherein said array comprises an arrangement of said rods in six adjoining rows of equal length formed into said six-sided array.

8. A game as defined in claim 7 wherein no rods of any given subset are in contact end-to-end or side-to-side with other rods of said given subset.

9. A game as defined in claim 8 wherein said six-sided array is a cylindrical shape with the first and last rows adjoining.

10. A game as defined in claim 9 and further comprising transparent means for retaining said predetermined array in said cylindrical shape.

11. A game as defined in claim 10 wherein said transparent means comprises a cylindrical container having internal partitions for retaining said rods in said predetermined array and a stopper for said container.

12. A game as defined in claim 1 wherein at least one of said pieces has scale lines inscribed upon its differingly designated surface, said one of said pieces occupying one of said sides others of said pieces in at least another one of said sides having dots inscribed upon their differingly designated surfaces, each of said dots being aligned with one of said scale lines when said pieces are combined to form said six-sided array.

13. A game as defined in claim 12 wherein said dots and said scale lines are located along the length of said pieces in accordance with the $\phi$ series.

14. A game as defined in claim 12 wherein said dots are inscribed upon the differingly designated surfaces of two pieces of each set.

15. A game comprising a set of rectangular rods at least some of which are unequal in length to others combinable to form a rectangular array, said set of rods including three subsets of different colors, said rectangular array including a plurality of rows of equal length in which no rods of a subset of a given color is in side-to-side or end-to-end contact with another rod of said given color, and means for forming said rectangular array into a cylinder in which the first and last of said rows adjoin, said cylinder having an axis parallel to the junctions of said rows wherein no rod of a given color in said first row and said last row is in side-to-side or end-to-end contact with another rod of said given color.

16. A game as defined in claim 15 wherein said means for forming said rectangular array into a cylinder comprises a transparent cylindrical container having internal partitions for retaining said rods in said rectangular array.

17. A game as defined in claim 16 and further including a stopper for closing said container in the form of a disc having an axial knob, said disc being inserted and slidably fitted in an end of said cylindrical container.

18. A game as defined in claim 16 wherein each of said rods has a width of $1/\phi$ units, said cylindrical container has an outside diameter of $\phi$ units and said stopper has an overall height of $1/\phi$ units whereby said rectangular array exhibits proportional form and color related to the $\phi$ factor.

* * * * *